US005388827A

United States Patent [19]

Reynolds, Jr.

[11] Patent Number: 5,388,827

[45] Date of Patent: Feb. 14, 1995

[54] GOLF PUTTER

[76] Inventor: Walker Reynolds, Jr., 14 Rendalia Rd., Anniston, Ala. 36201

[21] Appl. No.: 241,278

[22] Filed: May 11, 1994

[51] Int. Cl.[6] ..... A63B 53/02; A63B 53/04

[52] U.S. Cl. ..... 273/80.1; 273/80 R; 273/171

[58] Field of Search ..... 273/167 R, 168, 78, 273/169, 170, 171, 172, 173, 174, 175, 167 A, 167 B, 167 C, 167 D, 167 E, 167 F, 167 G, 167 H, 167 J, 167 K, 77 A, 80 R, 80 D, 80.1, 80.2, 164.1, 80.4, 80.8, 81.2

[56] References Cited

U.S. PATENT DOCUMENTS

| | | | |
|---|---|---|---|
| 3,392,977 | 7/1968 | Delacey | 273/80.1 |
| 3,397,888 | 8/1968 | Springer | 273/80.1 |
| 3,430,957 | 3/1969 | Andis | 273/80.1 |
| 4,714,252 | 12/1987 | Rorabeck | 273/171 |
| 5,039,098 | 8/1991 | Pelz | 273/80.1 |
| 5,137,275 | 8/1992 | Nelson | 273/80.1 |

*Primary Examiner*—Sebastiano Passaniti
*Attorney, Agent, or Firm*—Veal & Marsh

[57] ABSTRACT

A golf club, such as a putter, utilizes a removable shaft which is attached by threaded members extending axially of the shaft. The threaded members can be of varying weights to vary the pressure of the putter relative to the putting surface speed. Alternative embodiments affix the shaft with double threaded members.

10 Claims, 4 Drawing Sheets

19
18

19
29
18
24
23
38
41
16
17
16
13
41
34
11
12
32
12

GOLF PUTTER

FIELD OF THE INVENTION

The present invention relates generally to the game of golf and more particularly to the putters used in the play of the game. In greater particularity, the present invention relates to the construction of putters, wherein the head of the putter may be detachable from the shaft and the weight of the putter may be varied.

BACKGROUND

Golfing enthusiasts will appreciate that most golf clubs, including the putter, are manufactured in such a manner as to be unitized in construction. That is to say, the head and shaft are not readily separated from one another. Thus one is relegated to a single putter and is constrained to try many putters to get one that is satisfactory. It must be appreciated that putting is the most critical part of the golfer's game and that the saying "you drive for show, but you putt for dough!" emphasizes that the six foot putt counts just as much as the two-hundred and fifty yard drive, and that if the six foot putt is missed the subsequent six inch putt counts just as much as the other two. Also, the putter is the only club that the golfer expects to use on every hole. Thus, the confidence of the golfer in the putter is essential to enjoyment of the game and to being a competitive player.

The factor which is uncontrollable by the golfer is the speed of the greens on which he putts. The moisture content of the grass, the type of grass, the length of the grass, the proximity of water to the green, and the composition of the soil in the green, all affect the speed of the greens. Thus, playing on the same course on subsequent days often presents the golfer with greens that are remarkably different in speed on the same hole. Accordingly, a golfer who is intent on reducing his score will try to adjust his putter or his swing to accommodate the speed of the greens. In making an adjustment to the putter, the golfer may feel more secure using a shorter handled putter on faster greens or a lighter weighted putter on faster greens, yet subconsciously changing putters reduces the golfer's sense of well being. In other words, most golfers feel that they can hit their shots with their clubs better than they can with unfamiliar clubs including the putter, thus changing putter from day to day reduces the golfer's confidence. Likewise, if the golfer knows that the greens vary, he is somewhat concerned about using a putter that he cannot fine tune to the greens. It is known that there exist putters which can be adjusted in weight, including the inventor's own putter which is covered in U.S. Pat. No. Des. 282,480. However, merely adjusting the weight is not always sufficient to put the golfer's mind at ease. In as much as golf is a mental game, the improvements described hereinafter allow the golfer to fine tune his putter from day to day to satisfy himself that the putter is "right" and that he can use the club properly.

SUMMARY OF THE INVENTION

It is the object of the invention to provide a putter which will improve the game of a golfer who uses it regularly.

It is an object of this invention to provide a golfer with a putter which retains its familiarity even though its functional characteristics are varied.

It is a further object of the invention to provide a putter which can be fine tuned by the golfer to suit his playing preference in accordance with the speed of the greens on which he is playing.

These and other objects and features of the invention are accomplished in the provision of a putter wherein the putter head remains the same in appearance in as much as the same head is always used by the golfer. He is able to vary the length of the shaft to which the putter head is attached and to vary the weight of the putter. In the further disclosure of this application are three embodiments of the manner in which the shaft may be detachably affixed to the putter head. Each share a common feature in that the end of the shaft inserted into the putter head carries internally a threaded member which extends axially form the shaft into the head of the putter. In one embodiment the extension is captured by a set screw; in another the extension serves as a bolt type connection; and in a third embodiment the extension threads into the shaft and the head using oppositely threaded portions such that the shaft and head are drawn into firm engagement by rotation of the extension.

BRIEF DESCRIPTION OF THE DRAWINGS

Apparatus embodying my invention are depicted in the appended drawings which form a part of this disclosure and wherein.

DESCRIPTION OF THE PREFERRED EMBODIMENTS

Figure 1:
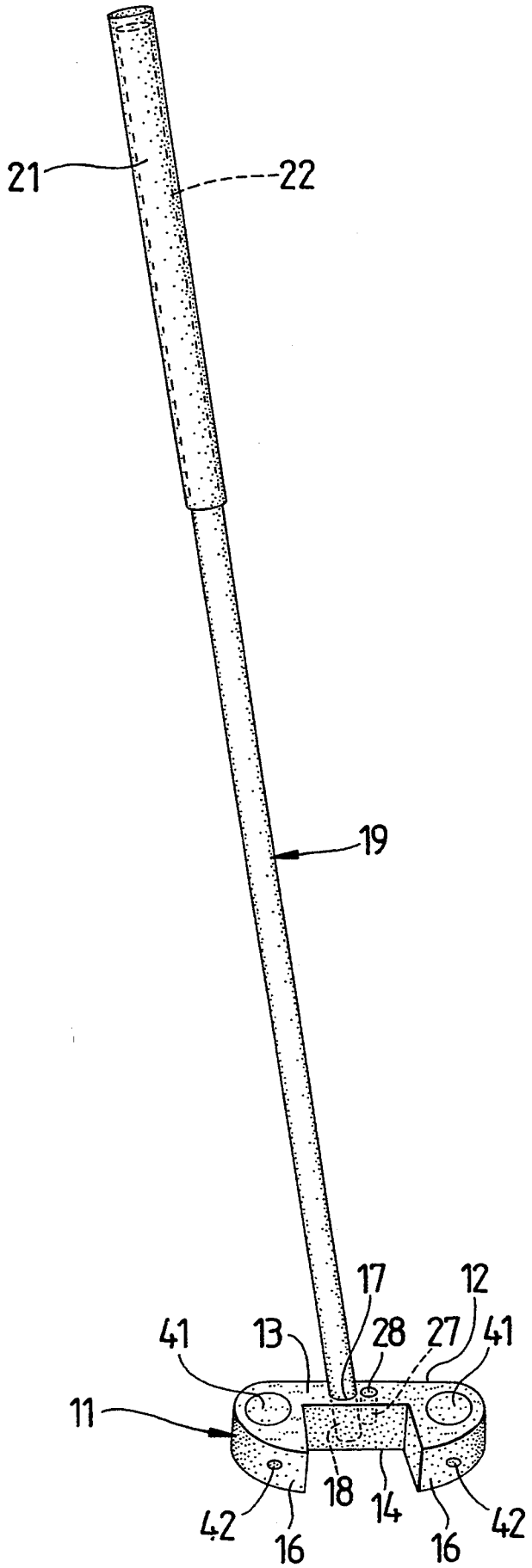
FIG. 1 is a perspective view of my putter.

Referring to the drawings for a clearer understanding of the invention it may be seen that I have chosen to illustrate the putter with a head in the form which I had previously patented in U.S. Pat. No. Des. 282,480. It should be understood that the teaching of the instant disclosure are not limited to putter heads which share the same ornamental appearance as this putter head, but rather are applicable to a variety of putter head shapes. The putter head is designated generally at 11 and includes a striking face 12, an upper surface 13, a lower surface 14, and a rear portion 16. The striking face is not impacted by my invention and little reference will be made thereto hereafter.

The upper surface 13 of the putter head has a bore 17 formed therein which extends downwardly at angle offset from normal to the upper surface 13 but parallel to the striking face 12. The bore 17 is appropriately sized to receive an end 18 of a shaft 19 in a snug fitting manner which allows insertion and withdrawal of the shaft 19 without deforming or galling of the adjacent surfaces. The opposite end 21 of the shaft carries thereon a grip 22 and will be referred to hereinafter as the grip end 21 with end 18 being referred to as distal end 18.

Figure 2:
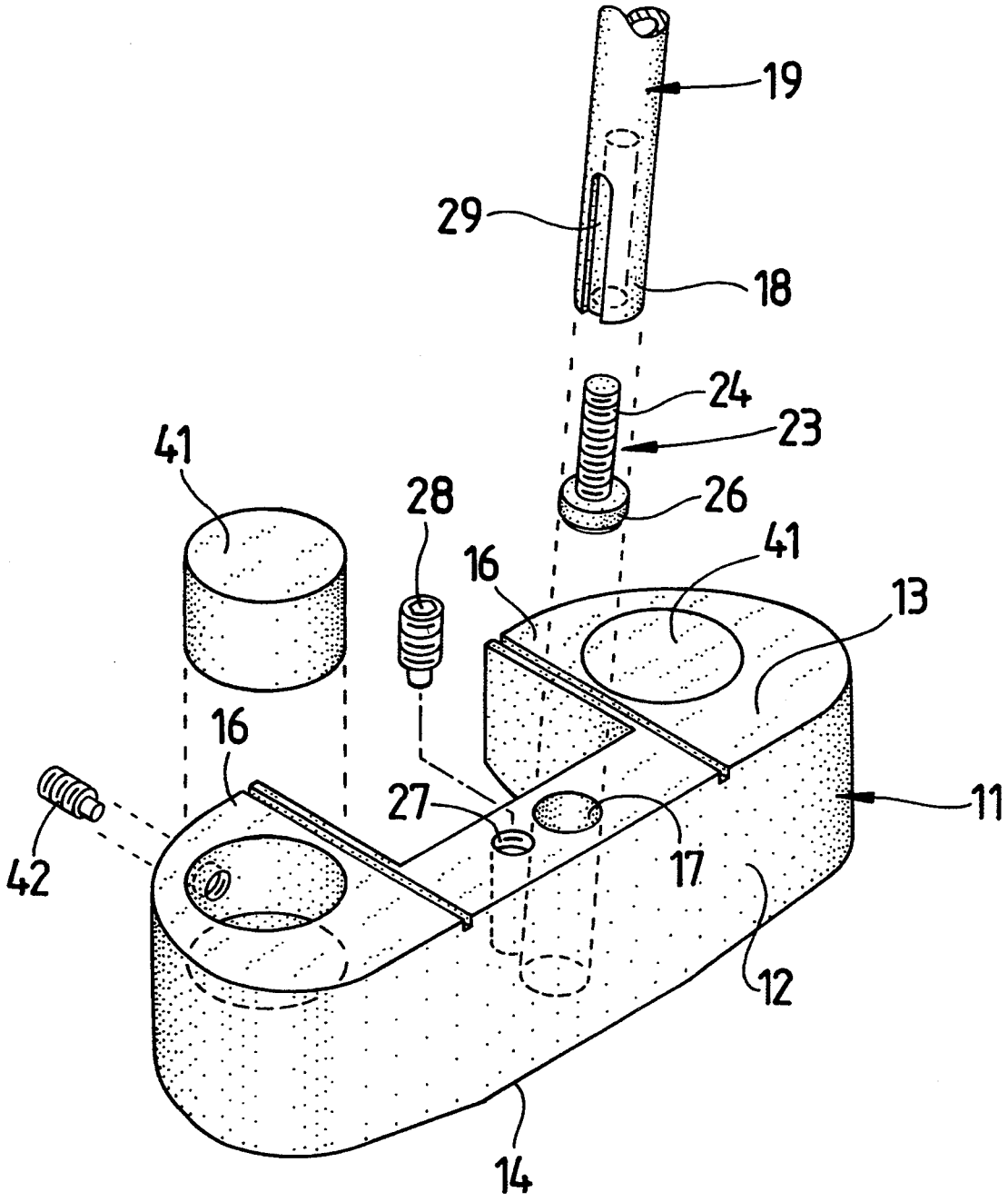
FIG. 2 is an exploded view of the putter components of the first embodiment.

As may be seen more clearly in FIG. 2 distal end 18 of the hollow shaft is threaded to receive therein an extension member 23, which includes a threaded portion 24 and a secondary portion 26. In FIG. 2 the secondary portion is an enlarged diameter portion which has a circumference which approximates that of distal end 18. Thus when extension member 23 is fully engaged within the threaded portion of distal end 18 the secondary portion 26 is in abutment with distal end 18. Due to the size of the bore 17, the distal end 18 and secondary portion 26 are readily received therein, therefore a secondary bore 27 having an internal thread formed therein is formed extending from upper surface 13 downwardly to intersect the bore 17 proximal the lower end thereof. A set screw 28 is threadably received therein and is readily adjusted with an Allen wrench or the like. A radially opening, longitudinally extending groove 29 is formed on the exterior of shaft 22 at the distal end 18 and is of sufficient width and depth to receive an end of the set screw 28. The groove is positioned to properly align the grip end with the putter head and allows the lower end of the set screw 28 to bear against the enlarged diameter secondary portion of the threaded member thereby locking the extension member and the distal end of the shaft into the head. It should be appreciated that the length of the threaded portion 24 may be varied and thereby the weight of the extension member may be varied thus one manner of varying the weight of the putter is to vary the length of the extension member. It will also be understood that the set screw can be loosened to allow the shaft to be removed and replaced by a shaft of a different length, thus varying weight and pendulum forces of the putter. That is to say that it is known that a shorter putter requires the golfer to assume more of a crouch to putt properly which in turn can be a conditioned stimulus to use the putter more delicately, as one might on faster greens.

Figure 3:
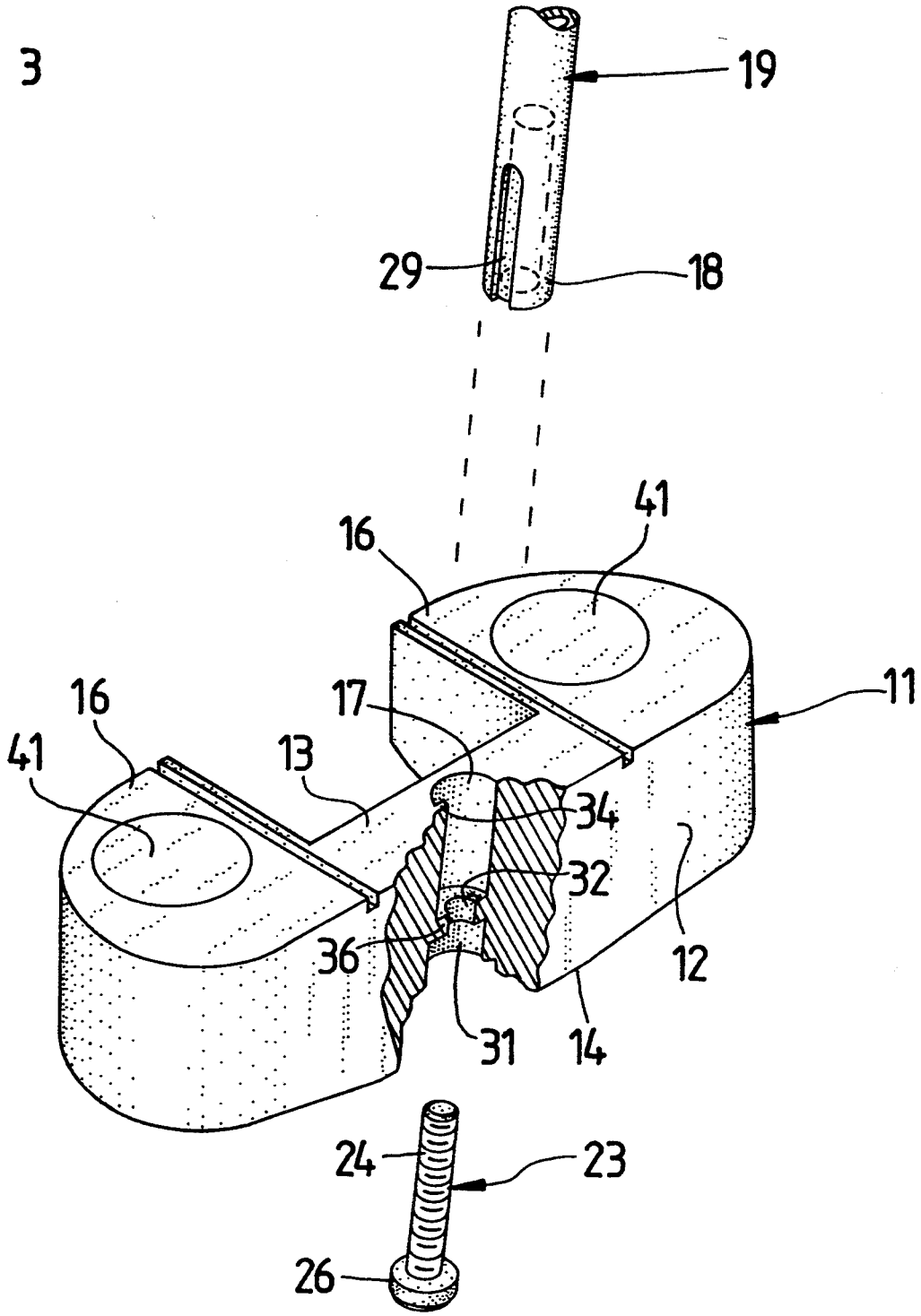
FIG. 3 is an exploded view of a second embodiment.

Referring to FIG. 3, one may note a second embodiment of the attachment mechanism wherein a recess 31 is formed in lower surface 14 and an aperture 32 provides communication between the recess 31 and bore 17. In this embodiment the extension member 23 is inserted into the bore through the aperture 32 and is rotated to threadably engage the distal end 18. In this embodiment a small key 34 is cast within bore 17 and aperture 32 is defined by a shoulder portion 36 separating recess 31 and bore 17. Key 34 extends perpendicular to shoulder portion 36 and is engaged within groove 29 when the distal end 18 is seated against shoulder portion 36.

Figures 4A, 4B:
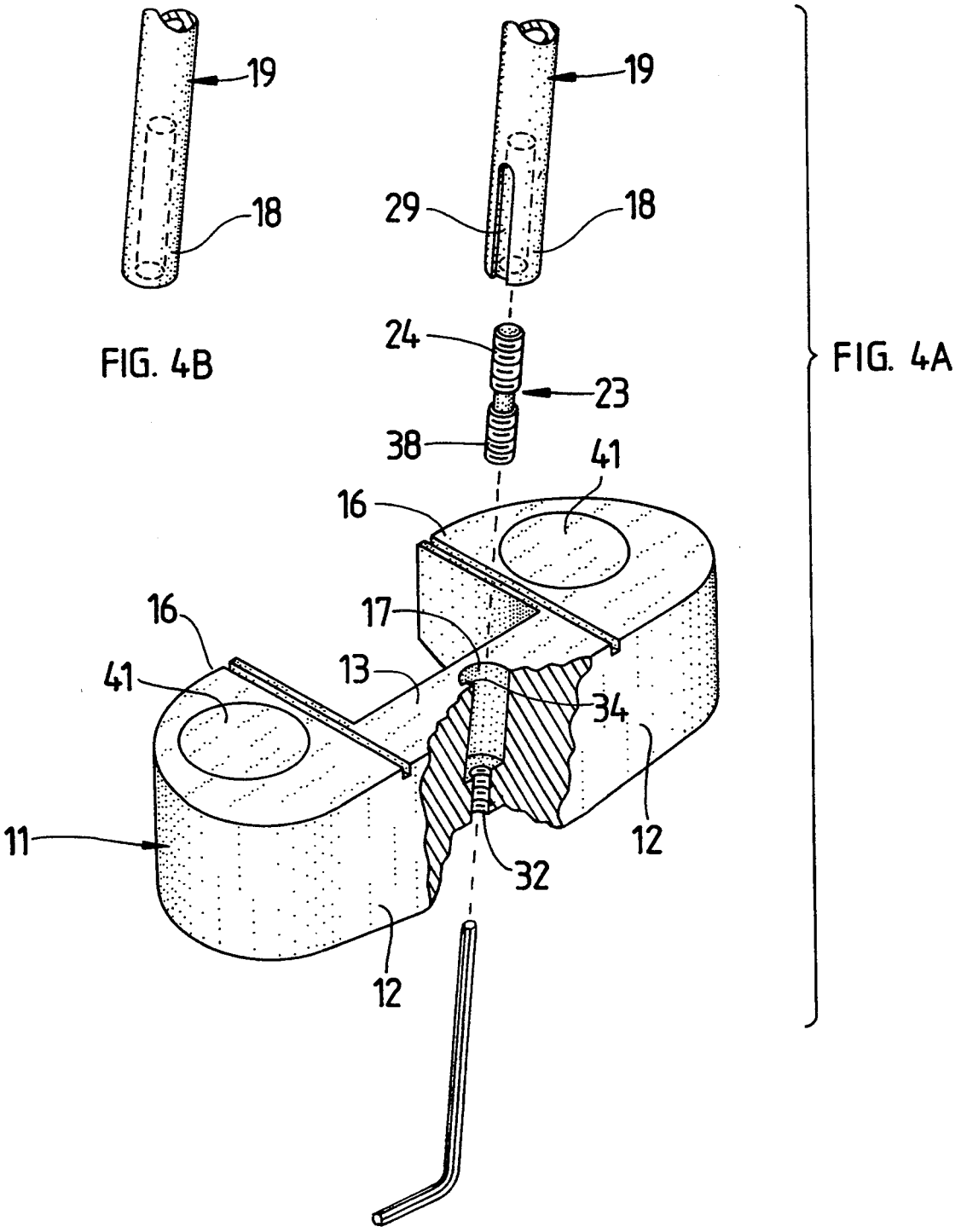
FIG. 4A is an exploded view of a third embodiment.
FIG. 4B is a partial view of the shaft without the alignment groove.

Referring to FIG. 4A, it may be seen that the extension member 23 may also be a double threaded bolt wherein the secondary portion 26 is replaced by a second threaded portion 38 which is threaded oppositely to threaded portion 24. Aperture 32 is threaded to engage the second threaded portion 38 such that the rotation of the extension member concomitantly increases the engagement of the extension member in both the shaft and the head thereby drawing the distal end of the shaft against the shoulder 36. In as much as only the extension member is required to rotate, the key 34 and groove 29 of the prior embodiment permit the shaft to be properly aligned; however, as shown in FIG. 4B, it is not necessary to use the key and groove in this embodiment, if the shaft and head are constrained in alignment during rotation of the extension member.

It will also be appreciated that the weight of the putter head may be increased or decreased by varying the weight of a set of inserts 41 secured within the head 11 by set screws 42 or any other suitable means as may be known within the art. In this manner, the club may attain a "counter balance" of mass which assists in truer strikes. That is to say, proper weight, weight distribution and shaft length can be attained in one club using my invention. Furthermore, the principle of weight distribution can be applied to all clubs from driver to putter using my invention.

While I have shown my invention in one form, it will be obvious to those skilled in the art that it is not so limited but is susceptible of various changes and modifications without departing from the spirit thereof.

Having set forth the nature of the present invention, what is claimed is:

1. A golf putter comprising in combination:

a) a shaft having a handle and a distal end, said distal end being tubular;

b) a head having a striking face and an upper surface perpendicular to said striking face, said upper surface having a bore formed therein, oblique to the surface thereof and parallel to said striking face, of a dimension adapted to receive said distal end;

c) a threaded member threadably received longitudinally within said distal end and having a terminal portion extending longitudinally beyond said distal end; and d) means for engaging said distal end and said threaded member within said bore for releasably securing the same to said head.

2. A golf putter as defined in claim 1 wherein said threaded member is replaceable with alternative threaded members of varying weight and length such that the overall weight of said putter is variable.

3. A golf putter as defined in claim 2 wherein said shaft is replaceable with an alternative shaft of a different length to provide a putter of a different length.

4. A golf putter as defined in claim 3 wherein said head includes removable weights which can be selectively exchanged with cooperatively formed weights to adjust the overall weight of the putter.

5. A golf putter as defined in claim 1 wherein said shaft is replaceable with an alternative shaft of a different length to provide a putter of a different length.

6. A golf putter as defined in claim 5 wherein said head includes removable weights which can be selectively exchanged with cooperatively formed weights to adjust the overall weight of the putter.

7. A golf putter as defined in claim 1 wherein said means for engaging comprises a set screw threadably received in a threaded bore in said upper surface, said threaded bore intersecting said obliquely formed bore such that said set screw is selectively movable to a locking position engaging said distal end proximal said terminal portion.

8. A golf putter as defined in claim 7 further comprising a radial groove formed in said shaft extending longitudinally from said distal end toward said handle and adapted to receive said set screw therein.

9. A golf putter as defined in claim 1 wherein said means for engaging comprises:

an aperture providing communication between said bore and a recess in a lower surface of said head, said recess being co-axially aligned with said aperture and said bore, said threaded member extending from within said recess through said aperture to engage said distal end.

10. A golf putter as defined in claim 1 wherein said means for engaging comprises a reduced diameter bore communicating within said bore and a recess formed in a lower surface of said putter head, said reduced diameter bore being threaded oppositely of said distal end, said terminal portion being threadably engagable with said reduced diameter bore.

* * * * *